US010450538B2

(12) United States Patent
Zander et al.

(10) Patent No.: US 10,450,538 B2
(45) Date of Patent: Oct. 22, 2019

(54) DETERGENT UNIT DOSES AND METHODS OF PRODUCING THE SAME

(71) Applicant: THE DIAL CORPORATION, Scottsdale, AZ (US)

(72) Inventors: Tasha Zander, Phoenix, AZ (US); Morgan Kelley, Glendale, AZ (US); Jeffrey Bankers, Phoenix, AZ (US); Kelly Adson, Tempe, AZ (US)

(73) Assignee: HENKEL IP HOLDING GMBH, Duesseldorf (DE)

( * ) Notice: Subject to any disclaimer, the term of this patent is extended or adjusted under 35 U.S.C. 154(b) by 273 days.

(21) Appl. No.: 14/954,349

(22) Filed: Nov. 30, 2015

(65) Prior Publication Data

US 2017/0152466 A1 Jun. 1, 2017

(51) Int. Cl.

| | |
|---|---|
| ***C11D 17/00*** | (2006.01) |
| ***C11D 17/04*** | (2006.01) |
| ***C11D 3/37*** | (2006.01) |
| ***C11D 3/42*** | (2006.01) |
| ***C11D 11/00*** | (2006.01) |
| ***B65B 5/04*** | (2006.01) |
| ***C11D 3/00*** | (2006.01) |

(52) U.S. Cl.

CPC ..... *C11D 17/043* (2013.01); *B65B 5/04* (2013.01); *C11D 3/0026* (2013.01); *C11D 3/3765* (2013.01); *C11D 3/42* (2013.01); *C11D 17/003* (2013.01)

(58) Field of Classification Search

CPC ... C11D 3/2082; C11D 11/0094; C11D 17/00; C11D 17/003; C11D 17/04; C11D 17/043; C11D 3/42

USPC ..... 510/403, 439, 108, 180, 214, 221, 223, 510/238, 280, 293, 295, 296, 297, 336, 510/445, 477

See application file for complete search history.

(56) References Cited

U.S. PATENT DOCUMENTS 4,169,067 A * 9/1979 Joshi ..... C11D 3/0084 510/153
4,207,198 A * 6/1980 Kenkare ..... C11D 3/2065 510/145
4,554,097 A 11/1985 Schebece et al.
(Continued)

FOREIGN PATENT DOCUMENTS

WO 2010076595 A1 7/2010

OTHER PUBLICATIONS

Korea International Searching Authority, International Search Report and Written Opinion for International Application No. PCT/US2016/063984 dated Mar. 17, 2017.

*Primary Examiner* — Lorna M Douyon
(74) *Attorney, Agent, or Firm* — Lorenz & Kopf LLP

(57) ABSTRACT

A unit dose of detergent and methods for producing the same are provided. In accordance with one embodiment, a unit dose comprises a body having a viscosity of from about 200,000 centipoise to about 50,000,000 centipoise at a working temperature of from about 0 to about 50 degrees Celsius, where the body has a bloom value of about 200 grams or more at the working temperature. The body comprises a detergent surfactant at from about 1 to about 40 weight percent based on the total weight of the body, and the body comprises a thickener at from about 10 to about 40 weight percent based on the total weight of the body.

20 Claims, 1 Drawing Sheet

(56) References Cited

U.S. PATENT DOCUMENTS

| | | | | |
|---|---|---|---|---|
| 4,828,752 | A * | 5/1989 | Nagarajan | C11D 9/225 510/130 |
| 5,244,652 | A | 11/1993 | Michaels | |
| 5,716,922 | A | 2/1998 | Curry et al. | |
| 2006/0069003 | A1 * | 3/2006 | Song | C11D 3/062 510/220 |
| 2008/0058239 | A1 * | 3/2008 | Evers | A45D 40/0075 510/193 |
| 2013/0065811 | A1 * | 3/2013 | Fernandez-Prieto | C11D 3/32 510/375 |
| 2013/0178409 | A1 | 7/2013 | Wortley et al. | |

* cited by examiner

DETERGENT UNIT DOSES AND METHODS OF PRODUCING THE SAME

TECHNICAL FIELD

The technical field relates to detergent unit doses and methods of producing the same, and more particularly relates to gelatinous detergent unit doses and methods of producing the same.

BACKGROUND

Unit doses of detergent are available for a variety of washing activities, such as clothes laundering and dish washing. The unit dose provides a pre-measured quantity of detergent that is easy to carry and convenient to use. The unit dose minimizes over-dosage of detergent and has proven popular with consumers.

One form of unit dose is the tablet, which has been in use for many years. Early examples of this type of unit dose included sachets that opened in the wash. The sachet had to be recovered at the end of the wash, which was inconvenient for the user. Therefore, water soluble sachets have been provided to eliminate the need for sachet recovery. Some forms of tablet use disintegrant materials that either swell or dissolve on contact with water. Other tablets use loosely sintered materials coated with a dicarboxylic acid based material for structural integrity. Still other examples use a water soluble container or skin that dissolves and disintegrates in water.

The various forms of unit dose generally require some time for water to release the detergent for cleaning purposes. In some cases the time required to release the detergent is longer than optimal. Furthermore, the various forms of unit dose generally increase the weight and bulk of the unit dose. In some cases, the unit dose can fail and produce an unpleasant mess, such as when a container or skin ruptures or a tablet becomes pulverized before use. The failed unit dose can contaminate other unit doses stored in proximity, such as in a common container, such that an entire package of unit doses becomes unpleasant to use.

Accordingly, it is desirable to provide a unit dose that reduces weight and failure rates of the unit dose, and methods of producing the same. In addition, it is desirable to provide unit doses that minimize the mess upon failure. Furthermore, other desirable features and characteristics will become apparent from the subsequent detailed description and the appended claims, taken in conjunction with the accompanying drawings and the foregoing technical field and background.

BRIEF SUMMARY

A unit dose of detergent and methods for producing the same are provided. In accordance with one embodiment, a unit dose comprises a body having a viscosity of from about 200,000 centipoise to about 50,000,000 centipoise at a working temperature of from about 0 to about 50 degrees Celsius, where the body has a bloom value of about 200 grams or more at the working temperature. The body comprises a detergent surfactant at from about 1 to about 40 weight percent based on the total weight of the body, and the body comprises a thickener at from about 10 to about 40 weight percent based on the total weight of the body.

In accordance with another embodiment a unit dose comprises a body that is elastic at a working temperature of from about 0 to about 50 degrees Celsius such that a deforming force can deform the body by about 30 volume percent from an initial shape for about 5 seconds or less, and the body returns to about the initial shape within about 10 seconds after removing the deforming force. An outer surface envelops the body, where the outer surface is exposed, and the outer surface is the same material as the body. The body comprises a detergent surfactant from about 1 to about 40 weight percent and a thickener from about 10 to about 40 weight percent, based on a total weight of the body.

In accordance with yet another embodiment a method or producing a unit dose comprises combining a detergent surfactant, water, and a thickener to form a detergent liquor. The detergent liquor comprises from about 1 to about 40 weight percent of the detergent liquor, from about 50 to about 90 weight percent water, and from about 10 to about 30 weight percent thickener, based on a total weight of the body. A thickener catalyst is added to the detergent liquor to produce a viscosity of from about 200,000 to about 50,000,000 centipoise. The detergent liquor is divided into the unit dose such that the unit dose weighs from about 15 to about 50 grams.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the unit dose, the method for forming the unit dose or the application and uses of the unit dose. Furthermore, there is no intention to be bound by any theory presented in the preceding background or the following detailed description.

Figure 1:
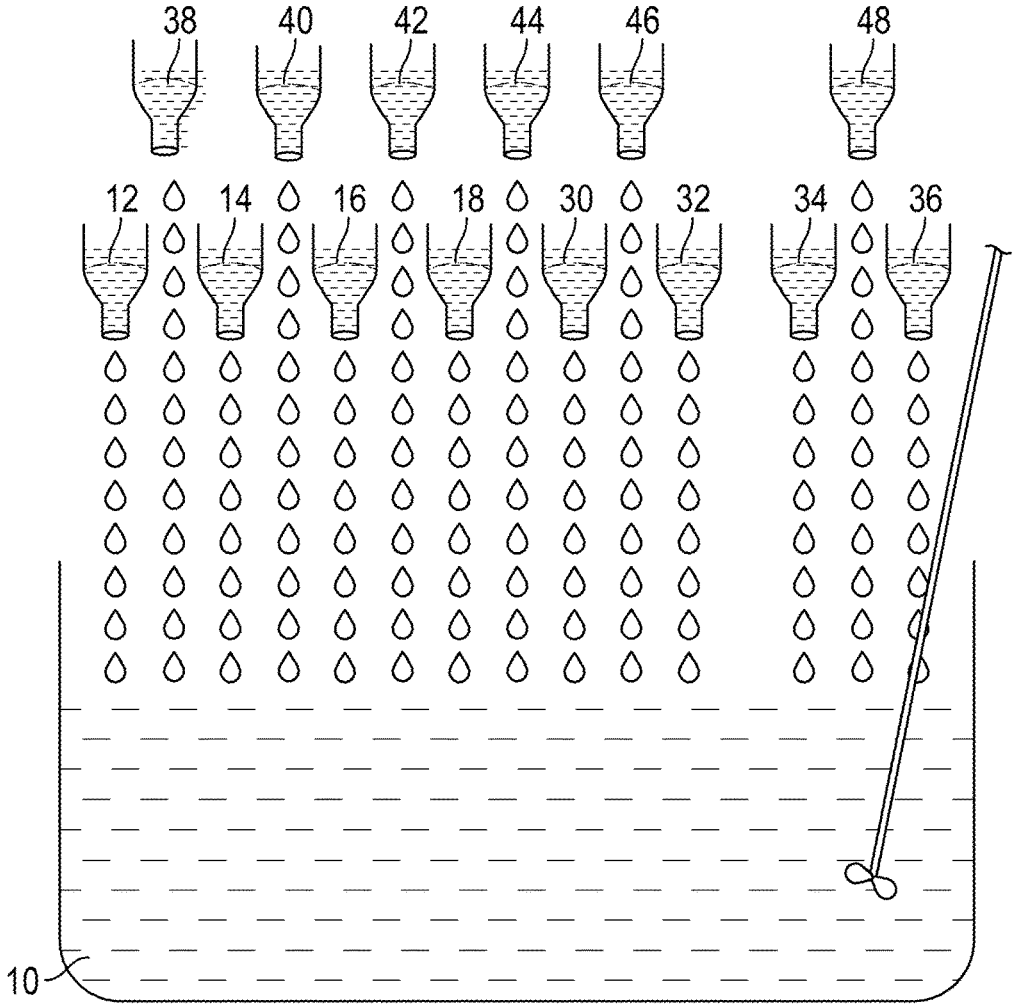
FIG. 1 illustrates an exemplary embodiment of a detergent liquor and a method of producing the same.

Referring to FIG. 1, a plurality of components are combined to form a detergent liquor 10. The plurality of components include water 12, a detergent surfactant 14, and a thickener 16, and may include several other components as described more fully below. In an exemplary embodiment, water 12 may be present in the detergent liquor 10 at from about 50 to about 90 weight percent, but water 12 may be present in the detergent liquor 10 at from about 60 to about 90 weight percent or from about 60 to about 80 weight percent in alternate embodiments, where the weight percents are based on a total weight of the detergent liquor 10. As such, the detergent liquor 10 is aqueous.

A wide variety of thickeners 16 can be added to the detergent liquor 10. The thickener 16 is used to form the detergent liquor 10 into a gelatinous material. A gelatinous material is a material that is deformable but tends to return to an original shape after being deformed. In one embodiment, a gelatinous material is "elastic." As used herein, "elastic" means a material in a body has an initial shape that can be deformed by up to about 30 volume percent by a deforming force using an object that is blunt enough to prevent the object from cutting into the body, where that body returns to about the initial shape within about 10 seconds after removing the deforming force, and where the deforming force is applied to the body for about 5 seconds or less. A body returns to "about an initial shape" if the body returns to a shape that occupies about 90 percent or more of the space occupied by the body before it was deformed. Some gelatinous materials may take a new shape if deformed for an extended period, such as about 5 hours or more, so the definition of "elastic" limits the amount of time that the body is deformed before returning to about the initial shape. In some embodiments, the body may "wobble" when returning to the initial shape, such that the body moves from the deformed shape to about the initial shape and then continues moving past the initial shape to a position opposite the deformed shape from the initial shape. The body may then return towards about the initial shape and continue moving to a position on the same side as the deformed shape, and the body may move back and forth a few times between different positions. The body will generally move smaller and smaller distances past the initial shape as time passes, and the body will generally come to rest at about the initial shape. As such, it may take some time, such as about 10 seconds, for the body to return to about its initial shape. Furthermore, there may be limits to the extent that an elastic material will deform before the gelatinous body is damaged such that the body does not return to about the initial shape. For example, if the body is deformed more than about 30 volume percent, or more than about 50 volume percent, or more than about 90 volume percent, the body or portions of the body may "break" such that the body does not return to about the original shape. In an exemplary embodiment, the elastic material remains elastic at a working temperature of from about 0 to about 50 degrees Celsius (° C.).

The gelatinous material of the detergent liquor 10 may have a high viscosity in some embodiments, such as a viscosity of from about 200,000 centipoise to about 50,000,000 centipoise at a working temperature of from about 0 to about 50° C. In alternate embodiments, the gelatinous material may have a viscosity of from about 500,000 centipoise to about 10,000,000 centipoise, or a viscosity of from about 1,000,000 to about 5,000,000 centipoise, all at the working temperature of from about 0 to about 50° C. The thickener 16 may be added to the point that physical behavior of the detergent liquor 10 transitions from mainly a liquid type material to an elastic type material, where the elastic material has a very high viscosity as described above.

The elastic behavior with a high viscosity also demonstrates gelatinous behavior, and the strength of the gelatinous, elastic material can be measured, such as with a bloom test. The gelatinous material may have a bloom value of about 200 grams or more at the working temperature of from about 0 to about 50° C., but in alternate embodiments the gelatinous material has a bloom value of about 400 grams or more or a bloom value of about 600 grams or more at the working temperature of about 0 to about 50° C. The gelatinous material of the detergent liquor 10 is not a rigid solid material, and can be temporarily deformed with the application of an outside force (such as pressure from a finger,) as described above. Bloom is a test to measure the strength of a gel or elastic body. The test determines the weight (in grams) needed by a probe to deflect the surface of the body by 4 millimeters (mm) without breaking it. The result is expressed in a bloom value with a value in grams or in other weights. The probe has a blunt round surface with a diameter of about 12.7 millimeters that contacts the surface of the gel. The bloom test is sometimes used with predetermined quantities of thickeners, water, and/or established temperatures, but the bloom test as used herein refers to a test of the detergent liquor 10 or other body as formulated, and at the temperature extremes of any named temperature range.

Many different types of thickeners 16 are available. In an exemplary embodiment, the thickener 16 is an acrylic or methacrylic copolymer dispersed in water. In some embodiments, the acrylic or methacrylic copolymer is somewhat insoluble in water at a low pH, such as a pH of about 7 or less, and the thickener 16 becomes much more soluble at a pH of more than about 7, such as a pH of from more than about 7 to about 14. In an alternate embodiment, the pH of the detergent liquor 10 is from about 7 to about 11.5 such that the thickener 16 becomes soluble and increases the viscosity of the detergent liquor 10. Monomers used to produce the thickener 16 may include acrylic and/or methacrylic acids, acrylic and/or methacrylic acid esters, vinyl acetate, acrylonitrile, and others. The thickener 16 may have a hydrophilic backbone with hydrophobic side chains. The hydrophobic side chains may include alkyl groups, aromatic groups, or other non-polar moieties, and the polymer backbone may include carboxylic acid moieties or other polar moieties. The carboxylic acid moieties may become ionized at a pH greater than about 7, such that the solubility of the polymer increases significantly when the pH is raised from a value of about 7 or less to a value greater than 7. The exact pH value where the solubility increases may vary in different embodiments, such that the pH value for increased solubility may be about 7, 7.5, 8, 8.5, or other values in various embodiments.

The thickener 16 may be added to the detergent liquor 10 at a pH of less than 7, and a thickener catalyst 18 may be added to bring the pH of the detergent liquor 10 up to a thickening value that ionizes the backbone and increases the solubility of the polymer such that the viscosity increases, such as a thickening pH value of more than about 7, or about 8.5 or more in different embodiments. As such, the thickener 16 may not increase thickness significantly until the detergent liquor 10 has a pH of more than the thickening value. The thickener catalyst 18 may be a wide variety of materials that can increase the pH, including but not limited to sodium hydroxide, potassium hydroxide, monoethanol amine, other amines, and many other compounds that can increase the pH of an aqueous solution.

The thickener 16 may be other compounds that increase viscosity in alternate embodiments. For example, the thickener 16 may be a biopolymer, such as xanthan gum, alginin, guar gum, or an inorganic material, such as clay. Other types of thickeners include gelatin, agar, carrageenan, arrowroot, corn starch, polyethylene glycol, petroleum jelly, polyurethanes, latex, polyvinyl alcohol, cellulosics, organosilicons, and others. Different types of thickener catalysts 18 may be used with different types of thickeners 16, and some thickeners 16 do not require the use of a thickener catalyst 18. For example, polyvinyl alcohol increases viscosity when the pH is low, as opposed to a higher pH for acrylic or methacrylic acid ester polymers, so a thickener catalyst 18 for a polyvinyl alcohol thickener 16 may be boric acid or some other type of acidic material. Some thickeners may increase viscosity based on physical changes. For example, gelatin thickeners 16 increases viscosity when dissolved at elevated temperatures and then subsequently cooled, and the increased viscosity is temperature dependent. Some thickeners 16 may be monomers, oligomers, or polymers that are subsequently polymerized and/or cross-linked to increase viscosity.

The thickener 16 may be added to the detergent liquor 10 to increase viscosity, where the quantity of thickener 16 added may be adjusted such that the desired strength of the gelatinous detergent liquor 10 is obtained. In some embodiments, a cleaning operation may be optimized by timing when the detergent surfactant 14 is added to an aqueous solution. For example, in a fabric washing system using a common household washing machine, it may be desirable to release the detergent surfactant 14 at a specific time after the wash cycle has begun. A stronger gelatinous material may delay the release of the detergent surfactant 14 (and other components in the detergent liquor 10) into the aqueous laundering solution compared to a weaker gelatinous material. In an exemplary embodiment using a thickener 16 comprising acrylic and/or methacrylic acid esters and a basic thickener catalyst 18, the thickener 16 may be present in the detergent liquor 10 at a concentration of from about 10 to about 40 weight percent, based on a total weight of the detergent liquor 10. In alternate embodiments, the thickener 16 may be in the detergent liquor 10 at a concentration of from about 12 to about 30 weight percent, or from about 13 to about 25 weight percent, based on a total weight of the detergent liquor 10.

Figure 2:
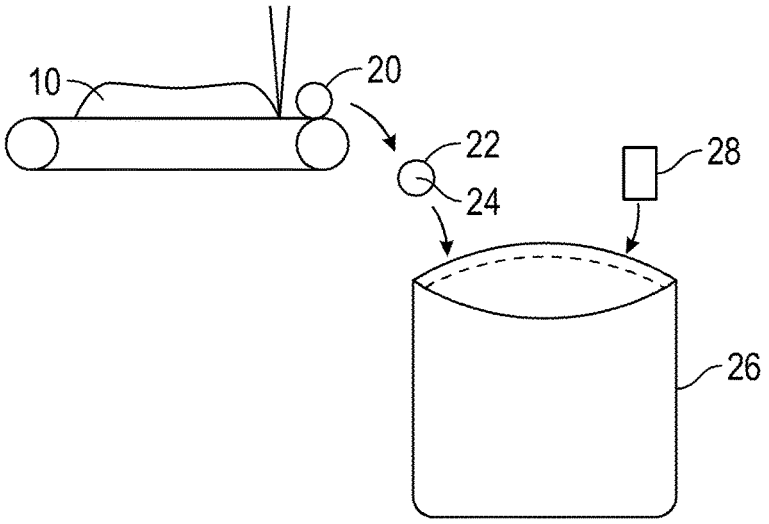
FIG. 2 illustrates an exemplary embodiment of a unit dose and methods of producing the same.

Referring to FIG. 2 with continuing reference to FIG. 1, the detergent liquor 10 is divided into discrete quantities to form a unit dose 20, where the unit dose 20 may retain the pH, elasticity, viscosity, and bloom value of the detergent liquor 10 at the working temperature. In alternate embodiments, the unit dose 20 may be formed after the thickener catalyst 18 is added but before the thickener catalyst 18 can act to increase the viscosity of the detergent liquor 10, in which case, after the thickener catalyst 18 increases the viscosity in the unit dose 20, the elasticity, viscosity, and bloom value of the unit dose 20 are all greater than that of the detergent liquor 10. The chemical make of the detergent liquor 10 is maintained in the unit dose 20 in many embodiments, so the concentration of the water 12, the detergent surfactant 14, the thickener 16, and other components in the detergent liquor 10 are the same as in the unit dose 20.

In an exemplary embodiment, the unit dose 20 is sized to provide a desired quantity of detergent surfactant 14 and other components for one load of laundry or one batch of dishes in a dishwasher. The unit dose 20 may also be sized for a fraction of a desired quantity, such as one half of a load of laundry, so a user can adjust the amount of detergent added without having to split a unit dose 20. In an exemplary embodiment, the unit dose 20 has a weight of from about 15 to about 50 grams. In alternate embodiments, the unit dose 20 is from about 20 to about 40 grams, or from about 20 to about 30 grams. The concentration of the components in the unit dose 20 (and the detergent liquor 10) is more fully described below.

The detergent liquor 10 may be divided into a unit dose 20 with a splitting device, such as a knife or blade, or the detergent liquor 10 may be divided into a unit dose 20 through a nozzle or other dispensing device. Other methods for dividing the detergent liquor 10 into a unit dose 20 may also be used. In some embodiments, the unit dose 20 may be formed into a desired shape. For example, a sheet of the detergent liquor 10 may be cut into a desired shape, such as a disc shape, a heart shape, a star shape, or other shapes. In an alternate embodiment, the unit dose 20 may be formed into a desired shape after being separated from the detergent liquor 10, such as a sphere, a tear drop, or other shapes.

The unit dose 20 has an outer surface 22 enveloping a body 24, and the elastic nature of the unit dose 20 may allow the outer surface 22 to be exposed without the contents of the body 24 spilling from the unit dose 20. An "exposed" outer surface 22, as used herein, indicates an outer surface that is free of a form-fitting enclosure. As such, in some embodiments the unit dose outer surface 22 is of the same material as the body 24 and the detergent liquor 10. The lack of a form-fitting enclosure allows wash water to directly contact the active ingredients as soon as the unit dose 20 contacts the wash water. This can speed the dissolution of active ingredients, which may improve wash performance in some embodiments. The lack of a form-fitting enclosure also may reduce (1) packaging waste, (2) the time and effort needed to add a unit dose 20 to a cleaning operation, and (3) packaging steps in the manufacturing process. The lack of a form-fitting package or enclosure may provide other benefits as well.

One or more unit doses 20 may be packaged in a container 26, such as a bag, a box, or other types of containers. In many embodiments, the unit dose 20 is not individually packaged, but it may be collectively packaged. Air or a void space is present between at least a portion of the container 26 and the unit dose 20, so the container 26 is not a form-fitting container. In an exemplary embodiment, the container 26 is re-sealable. Excessive humidity may reduce the elasticity, viscosity, or bloom value in some embodiments, so a re-sealable container 26 may help reduce humidity by minimizing the incursion of humid air. In some embodiments a desiccant 28 may optionally be added to the container 26 with the one or more unit doses 20 to help reduce the humidity. The desiccant 28 may be packaged in a bag or other device (not illustrated,) but the desiccant 28 may also be loosely scattered in the container 26 or added as a solid mass to the container 26. The container 26 may include a pouch (not illustrated) to hold the desiccant 28, where the pouch may be built into the container 28.

The detergent surfactant 14 was mentioned above, and may include one or more surfactants, with anionic surfactants, nonionic surfactants and mixtures thereof in particular being considered, but cationic and/or amphoteric surfactants may also be present. The detergent surfactant 14 may be present in the detergent liquor 10 at a concentration of from about 1 to about 40 weight percent in one embodiment, but the detergent surfactant 14 may be present in the detergent liquor 10 at a concentration of about 2 to about 30 weight percent or from about 5 to about 20 weight percent in alternate embodiments, where weight percents are based on a total weight of the detergent liquor 10.

Suitable nonionic surfactants include alkyl glycosides and ethoxylation and/or propoxylation products of alkyl glycosides or linear or branched alcohols in each case having 12 to 18 carbon (C) atoms in the alkyl moiety and 3 to 20, such as 4 to 10, alkyl ether groups. Corresponding ethoxylation and/or propoxylation products of N-alkylamines, vicinal diols, fatty acid esters and fatty acid amides, which correspond to the alkyl moiety in the stated long-chain alcohol derivatives, may furthermore be used. Alkylphenols having 5 to 12 C atoms may also be used in the alkyl moiety of the above described long-chain alcohol derivatives.

Suitable anionic detergent surfactants 14 comprise soaps and those which contain sulfate or sulfonate groups, including those with alkali metal ions as cations. Usable soaps comprise alkali metal salts of saturated or unsaturated fatty acids with 12 to 18 C atoms. Such fatty acids may also be used in incompletely neutralized form. Usable detergent surfactants 14 of the sulfate type include the salts of sulfuric acid semi esters of fatty alcohols with 12 to 18 C atoms and the sulfation products of the stated nonionic detergent surfactants 14 with a low degree of ethoxylation. Usable surfactants of the sulfonate type include linear alkylbenzene sulfonates with 9 to 14 C atoms in the alkyl moiety, alkane sulfonates with 12 to 18 C atoms, and olefin sulfonates with 12 to 18 C atoms, such as those that arise from the reaction of corresponding mono-olefins with sulfur trioxide, and alpha-sulfofatty acid esters such as those that arise from the sulfonation of fatty acid methyl or ethyl esters.

Suitable cationic detergent surfactants 14 may comprise textile-softening substances of the general formula X, XI, or XII as illustrated below:

(X)

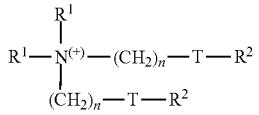

(XI)

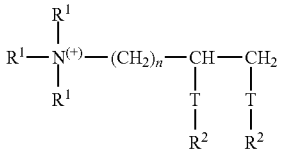

(XII)

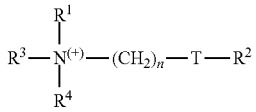

in which each $R^1$ group is mutually independently selected from among $C_{1-6}$ alkyl, alkenyl or hydroxyalkyl groups; each $R^2$ group is mutually independently selected from among $C_{8-28}$ alkyl or alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO—, or —CO—O—, and n is an integer from 0 to 5. The cationic detergent surfactants 14 may comprise conventional anions of a nature and number required for charge balancing, it being possible to select said anions not only from halides but also from anionic surfactants. In some embodiments, cationic detergent surfactants 14 that may be used are hydroxyalkyltrialkylammonium compounds, such as $C_{12-18}$ alkyl(hydroxyethyl)dimethyl ammonium compounds, and may include the halides thereof, such as chlorides or other halides. The cationic detergent surfactants 14 may be especially useful for compositions intended for treating textiles.

Such detergent surfactants 14 may be present in the detergent liquor 10 and in the unit dose 20 in proportions of about 5 weight percent to about 50 weight percent, but in alternate embodiments the detergent surfactants 14 may be present in the detergent liquor 10 and the unit dose 20 at from about 8 weight percent to about 30 weight percent. All weight percents of the detergent liquor 10 are based on the total weight of the detergent liquor 10, and all weight percents of the body 24 are based on the total weight of the body 24. In other embodiments, such as for disinfectants or general purpose cleaners, the detergent surfactants 14 may be present in the detergent liquor 10 and in the unit dose 20 at from about 0.1 weight percent to about 20 weight percent, or at from about 0.2 weight percent to about 5 percent.

Several components may optionally be added to and included in the detergent liquor 10, including but not limited to builder substances 30, enzymes 32, peroxy compounds 34, bleach activators 36, soil release agents 38, dye transfer inhibitors 40, optical brighteners 42, foam inhibitors 44, organic solvents 46, water softeners 48, and many other components. A partial list of additional components (not illustrated) that may be added to and included in the detergent liquor 10 and the unit dose 20 include electrolytes, pH regulators, graying inhibitors, anti-crease components, bleach agents, colorants, scents, processing aids, antimicrobial agents, and preservatives.

The builder substance 30 may include water-soluble and/or water-insoluble, organic and/or inorganic builder substances 30. In some embodiments, builder substances 30 are present in the unit dose 20 contemplated herein in quantities of up to about 60 weight percent (from about 0 to about 60 weight percent), or from about 5 weight percent to about 40 weight percent in another embodiment. Water-soluble organic builder substances 30 include polycarboxylic acids, such as citric acid and saccharic acids; monomeric and polymeric aminopolycarboxylic acids, such as methylglycinediacetic acid, nitrilotriacetic acid and ethylenediaminetetraacetic acid together with polyaspartic acid; polyphosphonic acids, such as aminotris(methylenephosphonic acid), ethylenediamine-tetrakis(methylenephosphonic acid) and 1-hydroxyethane-1,1-diphosphonic acid; polymeric hydroxyl compounds such as dextrin and polymeric (poly-) carboxylic acids, including polycarboxylates obtainable by oxidizing polysaccharides or dextrins, and/or polymeric acrylic acids; methacrylic acids and/or acrylic acids and maleic acids and copolymers thereof, which may also contain small proportions of polymerizable substances without carboxylic acid functionality; and synthetic polyacrylates. The relative molecular mass of the homopolymers of unsaturated carboxylic acids is in general between about 5,000 and about 200,000, that of the copolymers between about 2,000 and about 200,000, or between about 50,000 to about 120,000, in each case relative to free acid. One exemplary acrylic acid/maleic acid copolymer has a relative molecular mass of about 50,000 to about 100,000. Other suitable compounds of this class include copolymers of acrylic acid or methacrylic acid with vinyl ethers, such as vinyl methyl ethers, vinyl esters, ethylene, propylene and styrene, the acid fraction of which amounts to at least about 50 weight percent. Terpolymers containing as monomers two unsaturated acids and/or the salts thereof and, as a third monomer, vinyl alcohol and/or an esterified vinyl alcohol and/or a carbohydrate may also be used as water-soluble organic builder substances 30. The first acidic monomer or the salt thereof may be derived from a monoethylenically unsaturated carboxylic acid having 3 to 8 carbons (C3-C8), or from a C3-C4 monocarboxylic acid in an alternate embodiment, such as from (meth)acrylic acid. The second acidic monomer or the salt thereof may be a derivative of a C4-C8 dicarboxylic acid, such as maleic acid, and/or a derivative of an allylsulfonic acid that is substituted in position 2 with an alkyl or aryl residue. Such polymers generally have a relative molecular mass of between about 1,000 and about 200,000. Further suitable copolymers are those which comprise acrolein and acrylic acid/acrylic acid salts or vinyl acetate as monomers. The organic builder substances 30 may be used in aqueous solutions. All the stated acids are generally used in the form of the water-soluble salts, such as the alkali metal salts, thereof. Such organic builder substances 30 may, if desired, be present in the unit dose 20 in quantities of from about 0 up to about 40 weight percent in some embodiments, or in quantities of from about 1 to about 25 weight percent in other embodiments. In an exemplary embodiment the organic builder substances 30 may be present in quantities of from about 1 weight percent to about 8 weight percent.

Water-soluble inorganic builder substances 30 that may be considered are polymeric alkali metal phosphates, which may be present in the form of the alkaline, neutral, or acidic sodium or potassium salts thereof. Examples are tetrasodium diphosphate, disodium dihydrogen diphosphate, pentasodium triphosphate, sodium hexametaphosphate and the corresponding potassium salts or mixtures of sodium and potassium salts. Water-insoluble, water-dispersible inorganic builder substances 30 that may be used also include crystalline or amorphous alkali metal aluminosilicates, in quantities of from about 1 weight percent to about 5 weight percent. Among these, washing composition grade crystalline sodium aluminosilicates, such as zeolite A, P and optionally X, may be utilized. Suitable aluminosilicates may comprise no particles with a grain size of greater than about 30 micrometers (μm) and may consist of at least about 80 weight percent of particles with a size of less than about 10 μm. Their calcium binding capacity may be in the range of from about 100 to about 200 milligrams (mg) of calcium oxide per gram of building substance 30.

Suitable substitutes or partial substitutes for the stated aluminosilicates are crystalline alkali metal silicates, which may be present alone or mixed with amorphous silicates. The alkali metal silicates usable as builder substances 30 in the compositions contemplated herein may have a molar ratio of alkali metal oxide to silicon dioxide of less than about 0.95, such as from about 1:1.1 to about 1:12 and may be in amorphous or crystalline form. Exemplary alkali metal silicates are sodium silicates, such as amorphous sodium silicates, with a molar ratio of disodium oxide:silicon dioxide of from about 1:2 to about 1:2.8. Exemplary crystalline silicates, which may be present alone or mixed with amorphous silicates, are crystalline phyllosilicates of the general formula $Na_2Si_xO_{2x+i}\cdot y\ H_2O$, in which x, the "modulus", is a number of from about 1.9 to about 4 and y is a number of from about 0 to about 20. In some embodiments, the values for x are about 2, 3 or 4. Exemplary crystalline phyllosilicates are those in which x in the stated general formula assumes the values 2 or 3. In some embodiments, both β- and δ-sodium disilicates (Na2Si2O5.yH2O) may be used. Virtually anhydrous crystalline alkali metal silicates, produced from amorphous alkali metal silicates, of the above-stated general formula in which x means a number of from about 1.9 to about 2.1, may also be used in compositions herein. A crystalline sodium phyllosilicate with a modulus of 2 to 3, as may be produced from sand and soda, is used in other embodiments of compositions contemplated herein. Crystalline sodium silicates with a modulus in the range of from about 1.9 to about 3.5 are used in a yet other embodiments of compositions herein. In one exemplary embodiment of compositions contemplated herein, a granular compound of alkali metal silicate and alkali metal carbonate is used. If alkali metal aluminosilicate, such as zeolite, is present as an additional builder substance 30, the weight ratio of aluminosilicate to silicate, in each case relative to anhydrous active substances, may amount to from about 1:10 to about 10:1. In compositions that contain both amorphous and crystalline alkali metal silicates, the weight ratio of amorphous alkali metal silicate to crystalline alkali metal silicate may amount to from about 1:2 to about 2:1 or from about 1:1 to about 2:1 in other embodiments.

In some embodiments, the detergent liquor 10 contemplated herein comprises one or more enzymes 32 such as a protease, lipase, cutinase, an amylase, carbohydrase, cellulase, pectinase, mannanase, arabinase, galactanase, xylanase, oxidase, e.g., a laccase, and/or peroxidase. In general the properties of the selected enzyme(s) 32 should be compatible with the selected detergent liquor 10, (i.e., pH-optimum, compatibility with other enzymatic and non-enzymatic ingredients, etc.). The detergent enzyme(s) 32 may be included in the detergent liquor 10 by adding separate additives containing one or more enzymes 32, or by adding a combined additive comprising all of the enzymes 32 that are added to the detergent liquor 10. The enzyme(s) 32 should be present in the detergent liquor 10 in effective amounts, such as from about 0 weight percent to about 5 weight percent of enzyme 32, or from about 0.2 to about 2 weight percent, or from about 0.5 to about 1 weight percent in various embodiments.

A peroxy compound 34 may optionally be present in the detergent liquor 10 and in the unit dose 20. Exemplary peroxy compounds 34 include organic peracids or peracidic salts of organic acids, such as phthalimidopercaproic acid, perbenzoic acid or salts of diperdodecanedioic acid, hydrogen peroxide and inorganic salts that release hydrogen peroxide under the washing conditions, such as perborate, percarbonate and/or persilicate. Hydrogen peroxide may also be produced with the assistance of an enzymatic system, i.e. an oxidase and its substrate. Other possible peroxy compounds 34 include alkali metal percarbonates, alkali metal perborate monohydrates, alkali metal perborate tetrahydrates or hydrogen peroxide. Peroxy compounds 34 may be present in the detergent liquor 10 and in the unit dose 20 at from about 0 to about 50 weight percent, or from about 3 to about 30 weight percent, or from about 3 to about 10 weight percent in various embodiments.

Bleach activators 36 may optionally be added and included in the detergent liquor 10. Conventional bleach activators 36 that form peroxycarboxylic acid or peroxyimidic acids under perhydrolysis conditions and/or conventional bleach-activating transition metal complexes may be used. The bleach activator 36 optionally present may include, but is not limited to, one or more of: N- or O-acyl compounds, for example polyacylated alkylenediamines, such as tetraacetylethylenediamine; acylated glycolurils, such as tetraacetylglycoluril; N-acylated hydantoins; hydrazides; triazoles; urazoles; diketo-piperazines; sulfurylamides and cyanurates; carboxylic anhydrides, such as phthalic anhydride; carboxylic acid esters, such as sodium isononanoylphenolsulfonate; acylated sugar derivatives, such as pentaacetyl glucose; and cationic nitrile derivatives such as trimethylammonium acetonitrile salts. In order to avoid interaction with per compounds during storage, the bleach activators 36 may have been coated with shell substances or granulated prior to addition to the detergent liquor 10, in a known manner. Exemplary embodiments include tetraacetylethylenediamine granulated with the assistance of carboxymethylcellulose and having an average grain size of 0.01 mm to 0.8 mm, granulated 1,5-diacetyl-2,4-dioxohexahydro-1,3,5-triazine, and/or trialkylammonium acetonitrile formulated in particulate form. In various embodiments, the bleach activators 36 may be present in the detergent liquor 10 and the unit dose 20 in quantities of from about 0 to about 8 weight percent, or in quantities of from about 0.5 to about 6 weight percent, or in quantities of from about 2 to about 6 weight percent, in each case relative to the entire detergent liquor 10.

Soil release agents 38 may also be included in the detergent liquor 10 and the unit dose 20. Soil release agents 38 include polymers with a soil detachment capacity, which are also known as "soil repellents" due to their ability to provide a soil-repelling finish on the treated surface, such as a fiber. Soil release agents 38 may include nonionic or cationic cellulose derivatives. Polymers with a soil detachment capacity, in particular with regard to polyesters, include: copolyesters prepared from dicarboxylic acids, for example adipic acid, phthalic acid or terephthalic acid; diols, for example ethylene glycol or propylene glycol; and polydiols, for example polyethylene glycol or polypropylene glycol. In an exemplary embodiment, a soil release agent 38 includes polyesters with a soil detachment capacity that include those compounds which, in formal terms, are obtainable by esterifying two monomer moieties, the first monomer being a dicarboxylic acid HOOC-Ph-COOH and the second monomer a diol HO—(CHR$^{11}$—)aOH, which may also be present as a polymeric diol H—(O—(CHR$^{11}$—)$_a$)$_b$OH. Ph here means an ortho-, meta- or para-phenylene residue that may bear 1 to 4 substituents selected from alkyl residues with 1 to 22 C atoms, sulfonic acid groups, carboxyl groups and mixtures thereof. R$^{11}$ means hydrogen or an alkyl residue with 1 to 22 C atoms and mixtures thereof "a" means a number from 2 to 6 and "b" means a number from 1 to 300. The polyesters obtainable therefrom may contain not only monomer diol units —O—(CHR$^{11}$—)$_a$O— but also polymer diol units —(O—(CHR$^{11}$—)$_a$)$_b$O—. The molar ratio of monomer diol units to polymer diol units may amount to from about 100:1 to about 1:100, or from about 10:1 to about 1:10 in another embodiment. In the polymer diol units, the degree of polymerization "b" may be in the range of from about 4 to about 200, or from about 12 to about 140 in an alternate embodiment. The average molecular weight of the polyesters with a soil detachment capacity may be in the range of from about 250 to about 100,000, or from about 500 to about 50,000 in an alternate embodiment. The acid on which the residue Ph is based may be selected from terephthalic acid, isophthalic acid, phthalic acid, trimellitic acid, mellitic acid, the isomers of sulfophthalic acid, sulfoisophthalic acid and sulfoterephthalic acid and mixtures thereof. Where the acid groups thereof are not part of the ester bond in the polymer, they may be present in salt form, such as an alkali metal or ammonium salt. Exemplary embodiments include sodium and potassium salts.

If desired, instead of the monomer HOOC-Ph-COOH, the polyester with a soil detachment capacity (the soil release agent 38) may include small proportions, such as no more than about 10 mole percent relative to the proportion of Ph with the above-stated meaning, of other acids that comprise at least two carboxyl groups. These include, for example, alkylene and alkenylene dicarboxylic acids such as malonic acid, succinic acid, fumaric acid, maleic acid, glutaric acid, adipic acid, pimelic acid, suberic acid, azelaic acid and sebacic acid. Exemplary diols HO—(CHR$^{11}$—)$_a$OH include those in which R$^{11}$ is hydrogen and "a" is a number of from about 2 to about 6, and in another embodiment includes those in which "a" has the value of 2 and R$^{H}$ is selected from hydrogen and alkyl residues with 1 to 10 C atoms, or where R$^{11}$ is selected from hydrogen and alkyl residues with 1 to 3 C atoms in another embodiment. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. The polymeric diols include polyethylene glycol with an average molar mass in the range from about 1000 to about 6000. If desired, these polyesters may also be end group-terminated, with end groups that may be alkyl groups with 1 to 22 C atoms or esters of monocarboxylic acids. The end groups attached via ester bonds may be based on alkyl, alkenyl and aryl monocarboxylic acids with 5 to 32 C atoms, or with 5 to 18 C atoms in another embodiment. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, benzoic acid, which may bear 1 to 5 substituents having a total of up to 25 C atoms, or 1 to 12 C atoms in another embodiment, for example tert-butylbenzoic acid. The end groups may also be based on hydroxymonocarboxylic acids with 5 to 22 C atoms, which for example include hydroxyvaleric acid, hydroxycaproic acid, ricinoleic acid, the hydrogenation product thereof, hydroxystearic acid, and ortho-, meta- and para-hydroxybenzoic acid. The hydroxymonocarboxylic acids may in turn be joined to one another via their hydroxyl group and their carboxyl group and thus be repeatedly present in an end group. The number of hydroxymonocarboxylic acid units per end group, i.e. their degree of oligomerization, may be in the range of from 1 to 50, or in the range of from 1 to 10 in another embodiment. In an exemplary embodiment, polymers of ethylene terephthalate and polyethylene oxide terephthalate, in which the polyethylene glycol units have molar weights of from about 750 to about 5000 and the molar ratio of ethylene terephthalate to polyethylene oxide terephthalate of from about 50:50 to about 90:10, are used alone or in combination with cellulose derivatives.

Dye transfer inhibitors 40 may also be added to and included in the detergent liquor 10 and the unit dose 20. Exemplary dye transfer inhibitors 40 include, but are not limited to, polyvinylpyrrolidones, polyvinylimidazoles, polymeric N-oxides such as poly-(vinylpyridine-N-oxide), and copolymers of vinylpyrrolidone with vinylimidazole and optionally further monomers. Dye transfer inhibitors 40 may be present in the detergent liquor 10 at from about 0 to about 25 weight percent in some embodiments, but in other embodiments the dye transfer inhibitor 40 may be present in the detergent liquor 10 at from about 0.3 to about 25 weight percent, or from about 0.5 to about 5 weight percent.

Optical brighteners 42 may optionally be included in the detergent liquor 10. Optical brighteners 42 adsorb ultraviolet and/or violet light and re-transmit it as visible light, typically a visible blue light. Optical brighteners 42 include, but are not limited to, derivatives of diaminostilbene disulfonic acid or the alkali metal salts thereof. Suitable compounds are, for example, salts of 4,4'-bis(2-anilino-4-morpholino-1,3,5-triazinyl-6-amino)stilbene 2,2'-disulfonic acid or compounds of similar structure which, instead of the morpholino group, bear a diethanolamino group, a methylamino group, an anilino group or a 2-methoxyethylamino group. Optical brighteners 42 of the substituted diphenylstyryl type may furthermore be present, such as the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl)diphenyl. Mixtures of the above-stated optical brighteners 42 may also be used. Optical brighteners 42 may be included in the detergent liquor 10 at from about 0 to about 1 weight percent in some embodiments, but in other embodiments optical brighteners 42 are present at from about 0.01 to about 0.5 weight percent, or from about 0.05 to about 0.3 weight percent.

Foam inhibitors 44 may also optionally be included in the detergent liquor 10. Suitable foam inhibitors 44 include, but are not limited to, soaps of natural or synthetic origin, which comprise an elevated proportion of $C_{18}$-$C_{24}$ fatty acids. Suitable non-surfactant foam inhibitors 44 are, for example, organopolysiloxanes and mixtures thereof with microfine, optionally silanized silica as well as paraffins, waxes, microcrystalline waxes and mixtures thereof with silanized silica or bis-fatty acid alkylenediamides. Mixtures of different foam inhibitors 44 may also be used, for example mixtures of silicones, paraffins or waxes. In an exemplary embodiment, mixtures of paraffins and bistearylethylenediamide may be used. The foam inhibitors 44, in particular foam inhibitors containing silicone and/or paraffin, may be bound to a granular carrier substance that is soluble or dispersible in water. The detergent liquor 10 may include the foam inhibitor 44 at from about 0 to about 5 weight percent, but in other embodiments the foam inhibitor 44 may be present at from about 0.05 to about 3 weight percent, or about 0.5 to about 2 weight percent.

The detergent liquor 10 may also include organic solvents 46 in some embodiments. Organic solvents 46 that may be used include alcohols with 1 to 4 C atoms, such as methanol, ethanol, isopropanol and tert-butanol, diols with 2 to 4 C atoms, such as ethylene glycol and propylene glycol, and mixtures thereof and the ethers derivable from the stated classes of compounds. The organic solvents 46 may be included in the detergent liquor 10 at from about 0 to about 30 weight percent, or from about 2 to about 15 weight percent, or from about 2 to about 5 weight percent in various embodiments Water softeners 48 bind and remove calcium and magnesium from water, and may optionally be included in the detergent liquor 10. Many compounds can be used as water softeners 48, including but not limited to ethylenediaminetetraacetic acid (EDTA) or other chelating agents, sodium carbonate, sodium bicarbonate, sodium borate, calcium hydroxide, complex phosphates, sodium citrate, sodium silicate, and combinations thereof. Water softeners 48 may be present in the detergent liquor 10 at from about 0 to about 5 weight percent in an exemplary embodiment, but in alternate embodiments the water softeners 48 are present at from about 0.01 to about 3 weight percent or at from about 0.02 to about 1 weight percent.

Another exemplary embodiment is also directed to the use of a unit dose 20 as described herein in a cleaning process such as laundry and/or hard surface cleaning. In particular, an embodiment is directed to the use of a unit dose 20 in laundering of textile and fabrics, such as house hold laundry washing and industrial laundry washing. A further exemplary embodiment is directed to the use of a unit dose 20 in hard surface cleaning such as automated Dish Washing (ADW), car washing, and the cleaning of industrial surfaces.

The fabrics and/or garments subjected to a washing, cleaning or textile care process contemplated herein may be conventional washable laundry, such as household laundry. In some embodiments, the major part of the laundry is garments and fabrics, including but not limited to knits, woven, denims, non-woven fabrics, felts, yarns, and toweling. The fabrics may be cellulose based such as natural cellulosics, including cotton, flax, linen, jute, ramie, sisal or coir or manmade cellulosics (e.g., originating from wood pulp) including viscose/rayon, ramie, cellulose acetate fibers (tricell), lyocell or blends thereof. The fabrics may also be non-cellulose based such as natural polyamides including wool, camel, cashmere, mohair, rabbit, and silk, or the fabric may be a synthetic polymer such as nylon, aramid, polyester, acrylic, polypropylene and spandex/elastin, or blends of any of the above mentioned products. Examples of blends are blends of cotton and/or rayon/viscose with one or more companion material such as wool, synthetic fibers (e.g., polyamide fibers, acrylic fibers, polyester fibers, polyvinyl alcohol fibers, polyvinyl chloride fibers, polyurethane fibers, polyurea fibers, aramid fibers), and cellulose-containing fibers (e.g., rayon/viscose, ramie, flax, linen, jute, cellulose acetate fibers, lyocell).

In one embodiment, the fabrics and/or garments are added to a washing machine, and the unit dose 20 is also added to the washing machine before wash water is added. In an alternate embodiment, the unit dose 20 may be added to an automatic detergent addition system of a washing machine, where the contents of the unit dose 20 are added to the wash water with the fabrics and/or garments after the washing process has begun. In yet another embodiment, the unit dose 20 is manually added to the fabrics and/or garments with the wash water after the washing process has started. The unit dose 20 dissolves and breaks down in the aqueous wash water and releases the components within. The thickener 16 is dissolved and washes out of the washing machine with the excess wash water, so there is nothing to collect from the fabrics and/or garments after the wash cycle. The fabrics and/or garments are laundered with the wash water and the contents of the unit dose 20. The fabrics and/or garments may then be dried and processed as normal.

In an alternate embodiment, the unit dose 20 is added to a detergent charging system for an automatic dish washing machine. The detergent charging system opens and releases the unit dose 20 to the wash water and a main compartment of the dish washing machine at a designated point in the wash cycle. The contents of the unit dose 20 dissolve in the dish washing water and aid in washing the dishes or other contents of the dish washing machine.

In yet another embodiment, a unit dose 20 is added to a wash water solution that may be used for cleaning hard surfaces, such as floors, automobiles, windows, or other surfaces. The contents of the unit dose 20 are released to the wash water solution as the unit dose 20 dissolves, and the wash water solution can then be used for cleaning purposes.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A unit dose comprising:

a body having a viscosity of from about 200,000 centipoise to about 50,000,000 centipoise at a working temperature of from about 0 to about 50 degrees Celsius, wherein the body has a bloom value of about 400 grams or more at the working temperature;

a detergent surfactant within the body, wherein the body comprises from about 1 weight percent to about 40 weight percent of the detergent surfactant based on a total weight of the body;

water within the body, wherein the body comprises water at from about 50 to about 90 weight percent based on the total weight of the body; and a thickener within the body, wherein the body comprises from about 10 weight percent to about 40 weight percent of the thickener based on the total weight of the body.

2. The unit dose of claim 1 wherein the unit dose has a weight of from about 15 grams to about 50 grams.

3. The unit dose of claim 1 wherein the body comprises an outer surface enveloping the body, wherein the outer surface is exposed.

4. The unit dose of claim 1 wherein the viscosity of the body is from about 500,000 centipoise to about 10,000,000 centipoise.

5. The unit dose of claim 1 wherein the viscosity of the body is from about 1,000,000 to about 5,000,000 centipoise.

6. The unit dose of claim 1 wherein the bloom value of the body is about 600 grams or more.

7. The unit dose of claim 1 wherein the body is elastic such that a deforming force can deform the body by about 30 volume percent from an initial shape for about 5 seconds or less, and the body returns to about the initial shape within about 10 seconds after removing the deforming force.

8. The unit dose of claim 1 wherein the thickener comprises a synthetic polyacrylate.

9. The unit dose of claim 1 wherein the body has a pH of about 7 to about 11.5.

10. The unit dose of claim 1 wherein the body comprises water in an amount of from about 60 to about 80 weight percent.

11. The unit dose of claim 1 wherein the body further comprises:

an optical brightener in an amount of from about 0.01 to about 0.5 weight percent, based on the total weight of the body;

a builder in an amount of from about 5 to about 40 weight percent, based on the total weight of the body; and a foam inhibitor in an amount of from about 0.05 to about 3 weight percent, based on the total weight of the body.

12. The unit dose of claim 1 wherein the body is gelatinous.

13. A method of producing a unit dose according to claim 1 comprising:

combining a detergent surfactant, the water, and the thickener to form the detergent liquor;

adding a thickener catalyst to the detergent liquor to produce the detergent liquor with a viscosity of from about 200,000 centipoise to about 50,000,000 centipoise and a bloom value of about 400 grams or more at a working temperature of from about 0 to about 50 degrees Celsius; and dividing the detergent liquor into the unit dose, wherein the unit dose has a weight of from about 15 grams to about 50 grams.

14. The method of claim 13 further comprising:

packaging the unit dose in a re-sealable container.

15. The method of claim 14 further comprising:

packaging a desiccant in the re-sealable container.

16. The method of claim 13 further comprising:

adding an optical brightener to the detergent liquor at a concentration of from about 0.01 to about 0.5 weight percent of the total weight of the detergent liquor; and adding a foam inhibitor to the detergent liquor at a concentration of from about 0.05 to about 3 weight percent of the total weight of the detergent liquor.

17. A unit dose comprising:

a body that is elastic at a working temperature of from about 0 to about 50 degrees Celsius such that a deforming force can deform the body by about 30 volume percent from an initial shape for about 5 seconds or less, and the body returns to about the initial shape within about 10 seconds after removing the deforming force, wherein the body has a bloom value of about 400 grams or more;

an outer surface enveloping the body, wherein the outer surface is exposed, and wherein the outer surface is the same material as the body;

a detergent surfactant within the body, wherein the body comprises from about 1 weight percent to about 40 weight percent of the detergent surfactant, based on a total weight of the body; and a thickener within the body, wherein the body comprises from about 10 weight percent to about 40 weight percent of the thickener, based on the total weight of the body.

18. The unit dose of claim 17 wherein the unit dose has a weight of from about 15 grams to about 50 grams.

19. The unit dose of claim 17 wherein the body has a bloom value of about 600 grams or more.

20. The unit dose of claim 17 wherein the body further comprises:

a builder in an amount of from about 5 to about 40 weight percent, based on the total weight of the body; and a foam inhibitor in an amount of from about 0.05 to about 3 weight percent, based on the total weight of the body.

* * * * *